US011946362B2

(12) United States Patent
Ashford et al.

(10) Patent No.: US 11,946,362 B2
(45) Date of Patent: Apr. 2, 2024

(54) GRAVEL PACK SAND OUT DETECTION/STATIONARY GRAVEL PACK MONITORING

(71) Applicant: Halliburton Energy Services, Inc., Houston, TX (US)

(72) Inventors: Nicholas Cole Ashford, Midlothian, TX (US); Donald G. Kyle, Plano, TX (US); Michael Linley Fripp, Carrollton, TX (US); Kevin D. Fink, McKinney, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

(21) Appl. No.: 17/156,029

(22) Filed: Jan. 22, 2021

(65) Prior Publication Data

US 2022/0235648 A1 Jul. 28, 2022

(51) Int. Cl.
*E21B 43/04* (2006.01)
*E21B 47/09* (2012.01)

(52) U.S. Cl.
CPC ..... *E21B 47/09* (2013.01); *E21B 43/04* (2013.01)

(58) Field of Classification Search
CPC ..... E21B 43/04; E21B 47/00; E21B 47/06
See application file for complete search history.

(56) References Cited

U.S. PATENT DOCUMENTS 5,442,173 A 8/1995 Wraight
7,222,676 B2 5/2007 Patel et al.
7,346,456 B2 3/2008 Le Bemadjiel
9,803,467 B2 10/2017 Tang et al.
(Continued)

FOREIGN PATENT DOCUMENTS

CN 103244081 A 8/2013
EP 2467576 B1 11/2017
(Continued)

OTHER PUBLICATIONS

Sanchez, et al.; "Frac Packing: Fracturing for Sand Control"; Middle East & Asia Reservoir Review, No. 8; 2007; 5 pgs.

*Primary Examiner* — Tara Schimpf
*Assistant Examiner* — Lamia Quaim
(74) *Attorney, Agent, or Firm* — John Wustenberg; Parker Justiss, P.C.

(57) ABSTRACT

The disclosure provides a packing monitor, method, and gravel pack system for real-time monitoring of a particulate for improved gravel packing. Via the real-time monitoring, the quality of the gravel pack can be detected in real-time. Accordingly, a top-off procedure can be performed without additional tripping of the inner service tool string. Detecting when the gravel pack is approaching screen-out can also be determined in real-time. Detecting when screen-out is approaching allows the operator to prepare to stop pumping in case of miscalculations or early screen-out. In one example, the packing monitor includes: (1) a packing detector configured to, when stationary within the wellbore, obtain measurements indicating presence of a particulate in an annulus of the wellbore at different positions along a length of a screen; and (2) a packing controller configured to determine, based on the measurements, a status of the particulate in the annulus at the different positions.

21 Claims, 7 Drawing Sheets

(56) References Cited

U.S. PATENT DOCUMENTS

| | | | | |
|---|---|---|---|---|
| 9,840,908 | B2 | 12/2017 | Patel et al. | |
| 10,711,572 | B2 | 7/2020 | Greci et al. | |
| 2010/0017134 | A1 | 1/2010 | Steinman et al. | |
| 2012/0046866 | A1 | 2/2012 | Meyer et al. | |
| 2014/0083714 | A1 | 3/2014 | Grigsby | |
| 2018/0283145 | A1 | 10/2018 | Eliseev et al. | |
| 2019/0153857 | A1* | 5/2019 | Yi | E21B 47/14 |
| 2021/0041591 | A1* | 2/2021 | Riachentsev | G01V 3/28 |
| 2021/0396118 | A1* | 12/2021 | Yeung | F04B 49/08 |

FOREIGN PATENT DOCUMENTS

| | | | |
|---|---|---|---|
| WO | 2008020177 | A1 | 2/2008 |
| WO | 2011084529 | A2 | 7/2011 |
| WO | 2019182610 | A1 | 9/2019 |

* cited by examiner

600

700

GRAVEL PACK SAND OUT DETECTION/STATIONARY GRAVEL PACK MONITORING

BACKGROUND

One method for preventing the production of particulate to the surface during the production of hydrocarbons from a well is gravel packing the well adjacent a production zone. For a gravel pack completion, a completion string including a packer, a circulation valve, a fluid loss control device and one or more gravel-pack screens can be lowered into the wellbore to a position proximate the desired production interval. An inner service tool string can then be positioned within the completion string and a fluid slurry including a liquid carrier and a particulate is pumped through the circulation valve into the well annulus formed between the gravel-pack screens and the perforated well casing or open-hole production zone.

The liquid carrier either flows into the formation or returns to the surface by flowing through the gravel-pack screens or both. In either case, the particulate is deposited around the gravel-pack screens to form a gravel pack, which is highly permeable to the flow of hydrocarbon fluids but blocks the flow of the particulate carried in the hydrocarbon fluids. As such, gravel packs can successfully prevent the problems associated with the production of particulates from the formation.

SUMMARY

In one aspect, the disclosure provides a packing monitor for use in a wellbore. In one example the packing monitor includes: (1) a packing detector configured to, when stationary within the wellbore, obtain measurements indicating presence of a particulate in an annulus of the wellbore at different positions along a length of a screen, and (2) a packing controller configured to determine, based on the measurements, a status of the particulate in the annulus at the different positions.

In another aspect, the disclosure provides a method of gravel packing in a wellbore. In one example, the method includes: (1) pumping a fluid slurry into an annulus of the wellbore, wherein the annulus is partially defined by a screen and the fluid slurry includes a particulate, (2) obtaining stationary measurements indicating presence of the particulate in the annulus at different positions along a length of the screen, and (3) determining, based on the stationary measurements, a status of the particulate in the annulus at the different positions.

In yet another aspect, the disclosure provides a gravel packing system for a wellbore. In one example, the gravel packing system includes: (1) a screen, and (2) a packing monitor configured to determine, based on stationary axial measurements obtained during gravel packing, a status of a particulate at different positions along a length of the screen.

BRIEF DESCRIPTION

Reference is now made to the following descriptions taken in conjunction with the accompanying drawings, in which.

DETAILED DESCRIPTION

Figure 1:
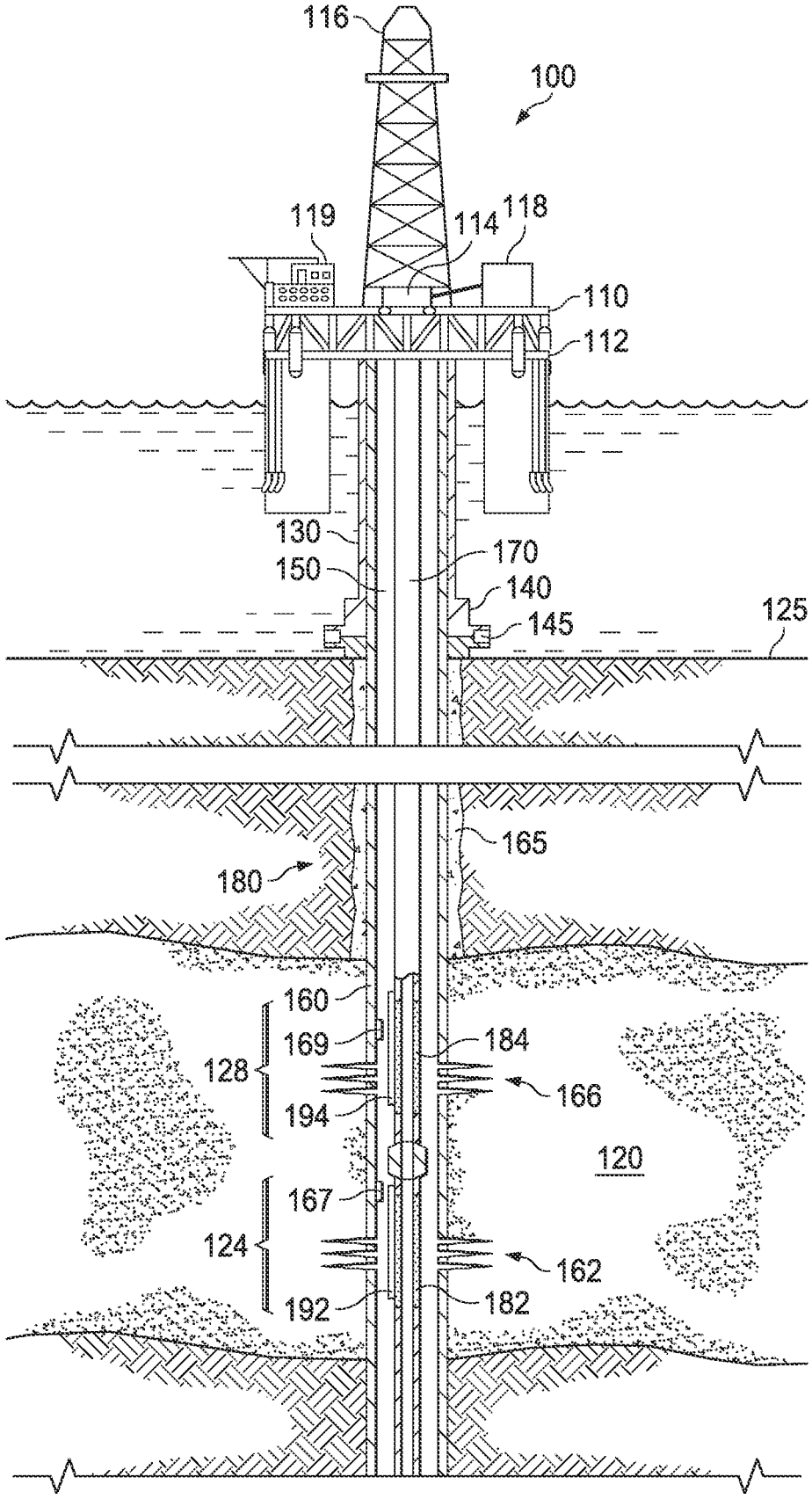
FIG. 1 illustrates a diagram of an example well system constructed according to the principles of the disclosure.

The inner service tool string can be used to isolate the production zones and reverse out the excess particulate when screen-out is detected at the gravel-pack screens (hereinafter screens). Screen-out occurs when the particulate being pumped down the inner service tool string has completely filled the available space of the well annulus formed between the screens and the perforated well casing or open-hole production zone. At this point, a pressure spike is typically observed, pumping is stopped, and excess particulate is reversed out of the wellbore. Unfortunately, screen-out is not always accurately calculated or detected. If pumping continues for a period of time after screen-out, the inner service tool string can become stuck downhole.

In addition to detecting screen-out, determining the quality of the gravel pack is also important. Typically the existing tools or methods used to evaluate the quality of a gravel pack and determine if voids exist require the use of wireline or manipulation of the inner service tool string at the surface. Often these methods provide post-packing analysis that occurs after the inner service tool string is removed from the wellbore. If a void is detected, the inner service tool string is run in the wellbore again to top-off the packing. As such, multiple trips into and out of the wellbore can be required to gravel pack the different production zones of the wellbore.

The disclosure provides a packing monitor, method, and gravel pack system for real-time monitoring of a particulate for improved gravel packing. Via the real-time monitoring, the quality of the gravel pack can be detected in real-time. Accordingly, a top-off procedure can be performed without additional tripping of the inner service tool string. Detecting when the gravel pack is approaching screen-out can also be determined in real-time. Detecting when screen-out is approaching allows the operator to prepare to stop pumping in case of miscalculations or early screen-out. As the progress of the gravel pack operation can be tracked in real time, the risk of having the inner service tool string being stuck downhole is significantly reduced.

The packing monitor can also be used to automatically open and close valves downhole during gravel packing. The valves can be part of a completion string within the wellbore. By operating the valves using the packing monitor, the inner service tool string could be simplified or eliminated completely, which would be a significant cost savings to those in the oil and gas industry.

The disclosed packing monitor can be strategically placed within a gravel-pack system to detect screen-out in real time. The packing monitor includes a packing detector configured to, when stationary within the wellbore, obtain measurements indicating presence of a particulate in an annulus of the wellbore at different positions along a length of a screen. The measurements indicating the particulate presence correspond to non-contacting emissions from the particulate. The measurements can reflect detection of an energy signature of the particulate, such as radiation or magnetic permeability.

The measurements obtained by the packing detector can be radiation measurements or magnetic permeability measurements. As such, the packing detector can be a group of radiation sensors, such as an array of sensors, that detect a radioactive tracer placed within a particulate, the inherent radioactivity of a particulate, or a combination of both. The radiation sensors can be distributed with a known spacing along a length that corresponds to a screen. For example, the sensors can be an array of radiation sensors spaced approximately six inches to one foot apart that corresponds to a length of a screen. More or fewer sensors may be utilized depending on the level of granularity needed. The radiation sensors may be, for example, a photodiode or Geiger Muller tube (a memory gamma sensor). The detected ionizing radiation can be alpha particles, beta particles, or gamma rays. As such, the packing detector can be a gamma radiation detector can measure over a given length. The packing detector can be a group of magnetic permeability sensors, such as an array of such sensors. A magnetic permeability sensor can be, for example, a Hall sensor or a magnetoresistive sensor, such as a giant magnetoresistive (GMR) sensor, and may include a source of magnetic flux such as a permanent magnet or an electromagnet. If placed at the top of the zone being serviced, the packing detector can detect the presence of the particulate as it fills the annulus. If placed at other positions in the zone, then the progression of the particulate within the zone can be tracked. Each sensor can be communicably coupled together to a packing controller which allows for individual access to each sensor in order to determine a status of the gravel packing process. For example, a gamma plot can be created based on the individual measurements from the sensors.

Regardless the placement, the packing detector is configured to obtain stationary axial measurements, which are multiple measurements obtained along a length by a device that is stationary with respect to the length. For example, a packing detector as disclosed herein can obtain measurements in a vertical wellbore without moving the packing detector up or down in the wellbore. The stationary axial measurements can be simultaneously obtained by multiple sensors that are located to correspond to identified positions, such as positions along the length of a screen.

The packing detector is communicatively coupled to a packing controller of the packing monitor. The packing controller is configured to determine, based on the measurements from the packing detector, a status of the particulate in the annulus at different positions along the length of the screen. The packing controller can be integrated with the packing detector in a single device or can be located distal from the packing detector. A single packing controller can be configured to operate with more than one group of sensors. For example, a packing controller can be used with an array of sensors from two different zones. As such, the packing controller, or at least a portion thereof, can be located at the surface or at another downhole location instead of integrated with the packing detector. Accordingly, the status can be determined downhole and sent to the surface or the measurements can be sent to another location, such as the surface or another downhole controller or computing device, and the status determined thereat. The status or measurements can be communicated using a communication system typically employed in a wellbore environment, including an acoustic system, fluid system, optical system, wired system, wireless system, or a combination of the various system. A wireless acoustic system employing repeaters can be used for at least a part of the communication. Regardless where determined, the status can be used for the packing operation.

Figure 4:
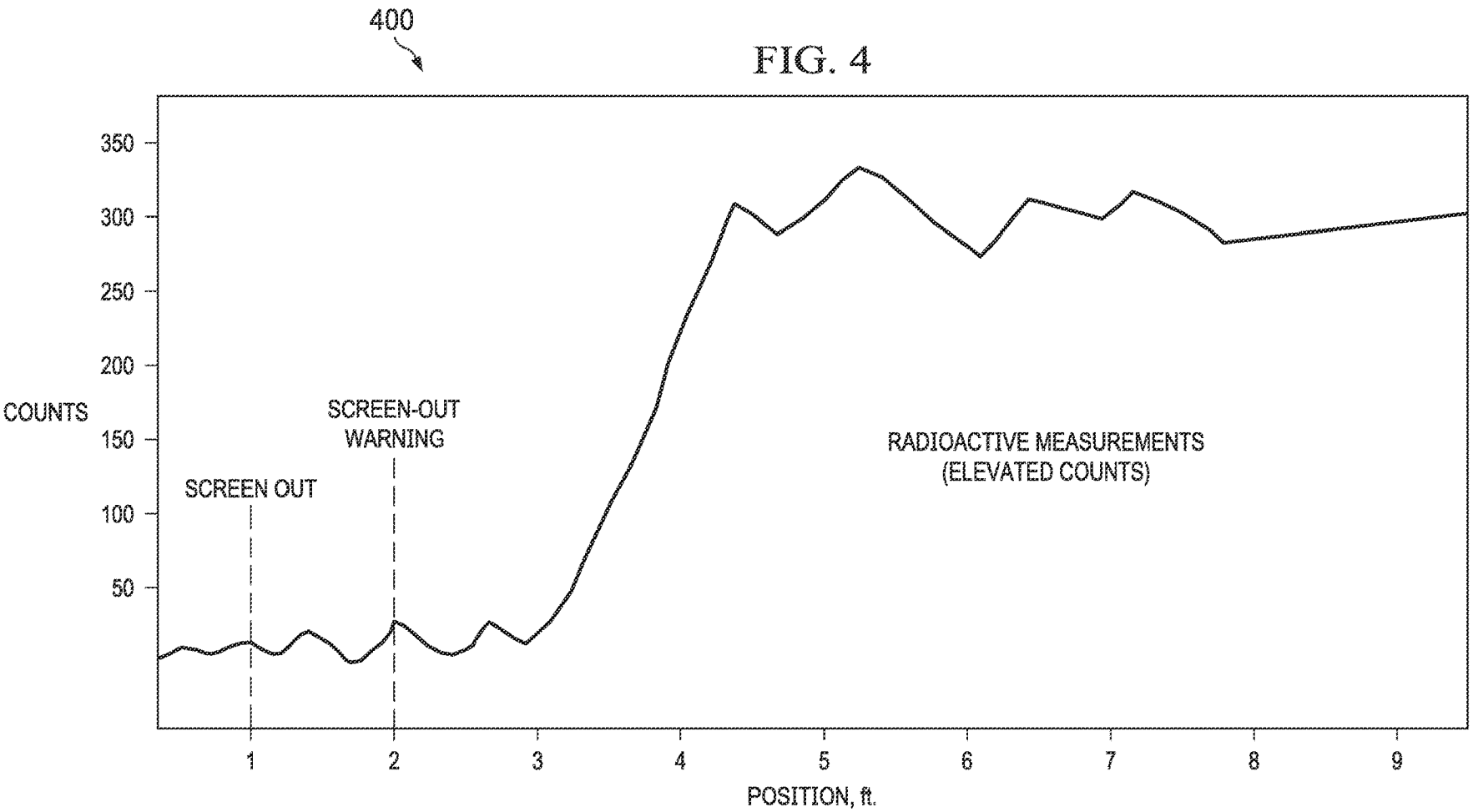
FIG. 4 illustrates a plot that shows an example of a status that can be generated by a packing monitor constructed according to the principles of the disclosure.
Figure 6:
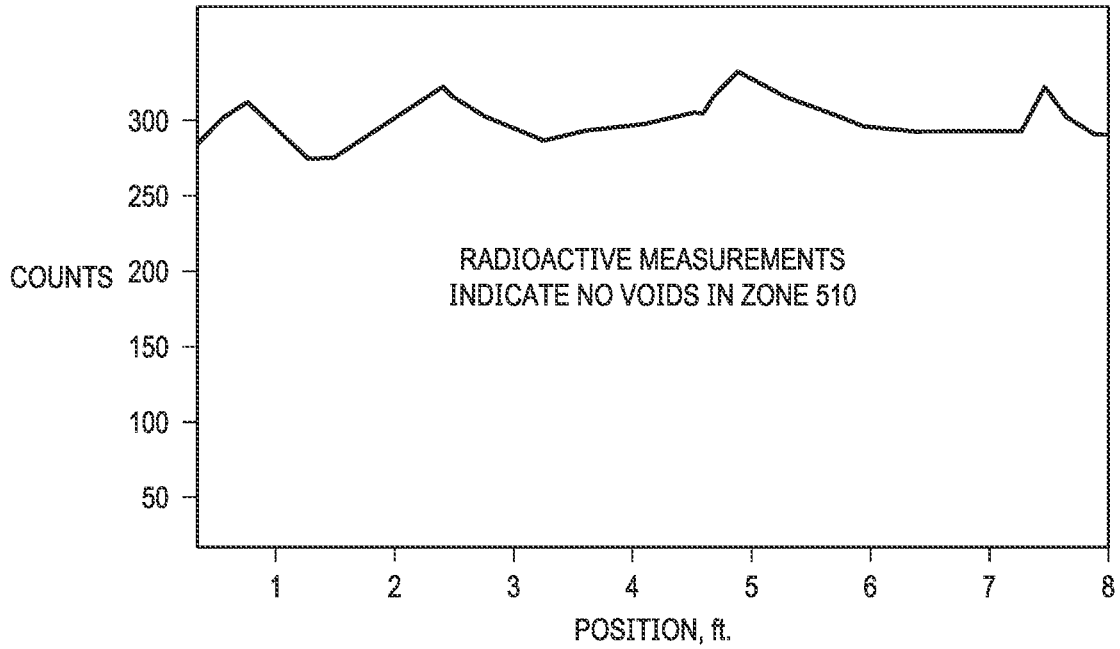
FIG. 6 illustrates a plot that shows another example of a status that can be generated by a packing monitor constructed according to the principles of the disclosure.
Figure 7:
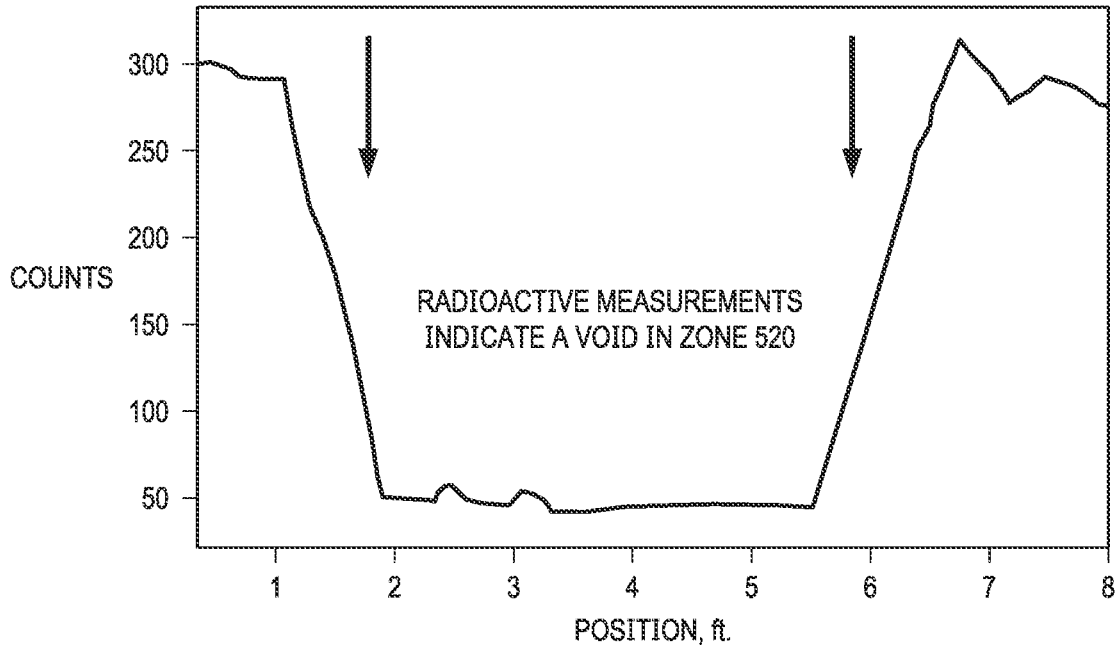
FIG. 7 illustrates a plot that shows yet another example of a status that can be generated by a packing monitor constructed according to the principles of the disclosure.

A computing device, such as at the surface, can automatically employ the status to modify a gravel-packing operation, such as changing an injection pressure, return pressure, flow rate, particulate concentration, alternative flow pathways, etc. A human operator can also manually modify the packing operation based on the status. For example, the status can be in the form of a plot, such as a gamma plot, that represents the particulate along the length of the screen. A human operator can view the plot on a display or a print out and manually modify the gravel-packing operation based on the plot. FIGS. 4 and 6-7 provide examples of plots generated by a packet controller that show the status. The packing controller can also automatically operate valves or sleeves of a completion assembly based on the status to modify a packing operation downhole. As such, the packing controller can automatically initiate downhole actions without transmitting the measurements or status up hole. Accordingly, an inner working tool string may not be needed for gravel packing.

FIG. 1 illustrates a diagram of an example well system 100 constructed according to the principles of the disclosure. The well system 100 includes a semi-submersible platform 110 positioned over a submerged hydrocarbon formation 120, which is located below sea floor 125. The well system 100 includes a subsea conduit 130 that extends from a deck 112 of the platform 110 to a wellhead installation 140, which may include one or more subsea blow-out preventers 145. A wellbore 150 extends through the various earth strata including the formation 120. Wellbore casing 160 is cemented within wellbore 150 by cement 165. Platform 110 has a hoisting apparatus 114, which may include a rotary table, and a derrick 116 for raising and lowering pipe strings, such as work string 170.

The platform 110 also has a packing pump 118 for conducting gravel packing within production zones of the subterranean formation 120. The packing pump 118 pumps a fluid slurry with a liquid carrier and particulate downhole for the packing and a clean-out bin (not shown) receives the portion of fluid slurry that returns to the surface.

The platform 110 includes a control system 119 that directs the operation of the well system 100. The control system 119 can be used to control the packing pump 118 and downhole equipment, such as completion assembly 180 connected to the work string 170. The control system 119 can include a computing device having a processor, memory, and display. The processor can be configured to perform at least some of the functions of a packing controller as disclosed herein. For example, the processor can automatically initiate a change in the gravel packing operation based on measurements or status. The display can be used to show a status determined by a packing controller. An operator can manually alter the gravel packing process based on the status. In addition to a visual presentation, computing device can also provide audible signals to indicate the status. For example, a first signal can be sounded for a screen-out warning, a second signal for screen-out, a third signal indicating a void, a fourth signal indicating no void, etc. The memory can be used to store measurements obtained by a packing detector and statuses determined by a packing controller. The control system 119 can be communicatively coupled to the completion assembly 180 or other downhole equipment via a communication system typically employed in a wellbore environment, including an acoustic system, fluid system, optical system, wired system, wireless system, or a combination of the various system.

Figure 2:
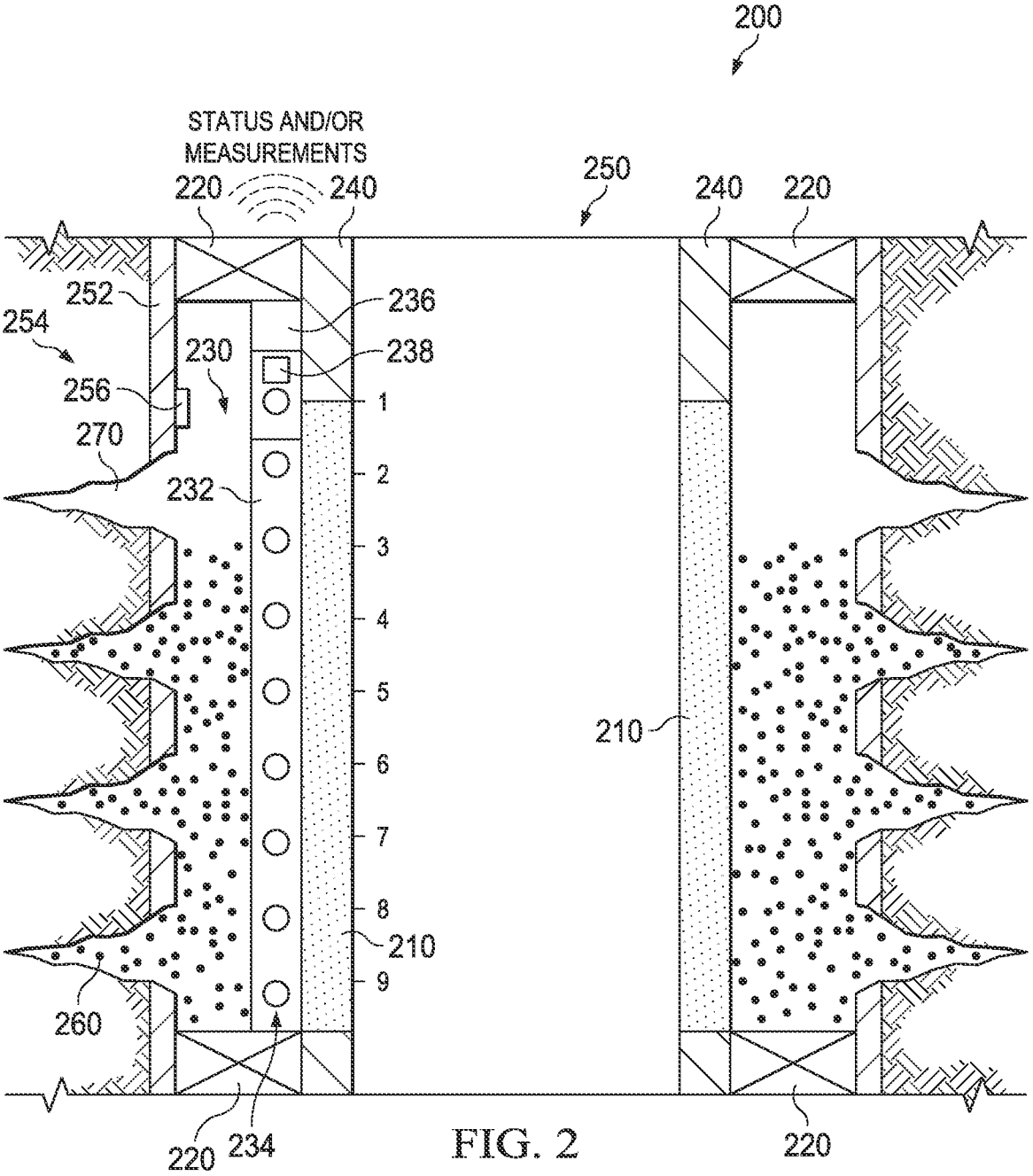
FIG. 2 illustrates a diagram of an example of a gravel packing system constructed according to the principles of the disclosure.
Figure 3:
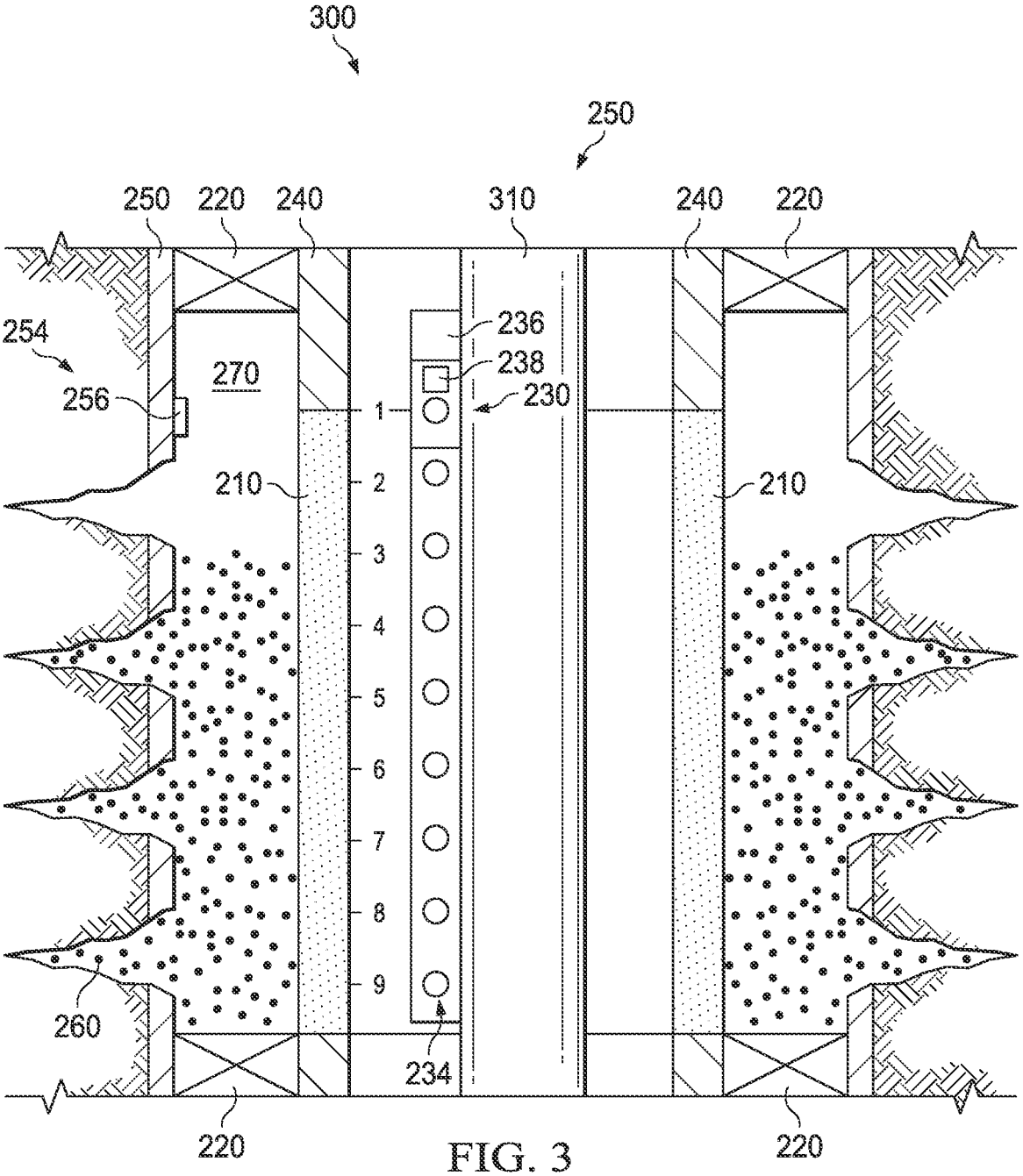
FIG. 3 illustrates a diagram of another example of a gravel packing system constructed according to the principles of the disclosure.

Completion assembly 180 has been run within casing 160. The completion assembly 180 can be used for gravel packing within production zones of interest, including a first zone 124 (e.g. a lower zone) and a second zone 128 (e.g. an upper zone) within the subterranean formation 120. For gravel packing annular regions 162, 166, the completion assembly 180 is lowered through the casing 160 to position screens 182, 184, of the completion assembly 180 within the first zone 124 and the second zone 128. Radiation tags and sensors can be used to position the screens 182, 184, at the proper depth in the wellbore 150. The radiation tags can be located inside casing 160 or adjacent thereto (e.g., inside the wellbore 150) at some known depth. Radiation tags 167 is shown in the wellbore 150 and radiation tag 169 is shown within the casing 160. The sensors can be one or more sensors of packing monitors that are used to monitor the distribution of particulate along the length of the screens 182, 184. Packing monitor 192 is used with screen 182 and packing monitor 194 is used with screen 184. The packing monitors 192, 194, determine a status of the particulate during gravel packing and can transmit the status to the control system 119 for modification of the gravel packing operation. The packing monitors 192, 194, can be attached to the screens 182, 184, as shown in FIG. 1. Alternatively, one or more packet monitors can be attached to an inner service tool string (not shown) that is positioned within the completion assembly 180. The packing monitors 192, 194, can be mechanically attached to a screen or tool string via a mechanical connection, such as via bolts, bands, integrated with the oilfield tubular, threaded, clamped, etc. Screen 182 and packing monitor 192 and screen 184 and packing monitor 194 can be part of can be part of a single gravel pack system. For example, screens 182, 184, and packing monitors 192, 194, can be part of a lower completion assembly, such as a dual zone selective gravel pack assembly that can gravel pack two tones in a single trip. Another type of gravel pack assembly, such as for packing a single zone, can also be used with the packing monitors 192, 194. A gravel pack system can include additional components typically included with packer assemblies, such as packers that are used to control the lateral flow of particulate in the annulus. Packing monitor 230 of FIGS. 2-3 provide an example of packing monitors 192, 194.

When appropriately positioned, the completion assembly 180 may be run through various positions to assure proper operation thereof. Thereafter, a fluid slurry including a liquid carrier and a particulate, such as sand, gravel or proppants, is pumped down work string 170 to pack the annular regions 162 and 166 with the particulate. Various sleeves, or valves, of completion assembly 180 can be operated to direct the flow of the fluid slurry for packing. The sleeves can be operated by an inner service tool string. The sleeves can also be automatically operated by the packing monitor based on a packing status of the particulate in the annulus along a length of a sleeve. For example, packing monitor 192 may determine that screen-out is approaching for screen 182 and open and close sleeves of the completion assembly 180 to redirect the flow of the slurry out of zone 124. The completion assembly 180 can be a tubing assembly that allows operating of sleeves without tool movement. For example, the tubing assembly of U.S. Pat. No. 10,711,572, which is incorporated herein by reference in its entirety, provides an example of an assembly that the packing monitor 192 can communicate with to operate sleeves.

When utilized, an inner service tool string located within the completion assembly 180 can be pulled out of the wellbore 150 after completion assembly 180 has been used to gravel pack the first and second zones 124, 128. In the process of pulling an inner service tool string out of the wellbore 150, an isolation plug of the completion assembly 180 may be set, a sliding sleeve in the first zone 124 may be closed, and a sliding sleeve in the second zone 128 may be closed. At this stage, the first and second zones 124, 128 can be fully isolated from each other, as well as the upper and lower portions of the wellbore 150. With the first and second zones 124, 128 isolated, the inner service tool string can be fully pulled up hole, leaving the completion assembly 180 intact downhole. As this stage, an upper completion assembly (not shown) may be run downhole, and one or both of the sliding sleeves may be opened (e.g., mechanically or hydraulically opened), thus opening one or both of the first and second zones 124, 128 for production. Instead of utilizing an inner service tool string, completion assembly 180 can include sleeves that can be operated from the surface to isolate the first and second zones 124, 128 and open one or both for production.

Even though FIG. 1 depicts a vertical well, it should be noted by one skilled in the art that the packing monitor and packing assembly as disclosed herein can also be used in other well configurations including, but not limited to, inclined wells, wells with restrictions, deviated wells or horizontal wells. For non-vertical wells, the packing controller of the packing monitor can be configured to compensate for the distribution of the particulate along a length of the screen according to an angle of the non-vertical wellbore, for example by noting the particulate concentration at different circumferential locations along a tubing string or by noting the particulate concentration at different axial positions along the length of the tubing string. Also, even though FIG. 1 depicts an offshore operation, those skilled in the art understand that the principles of the disclosure are equally as applicable in other subterranean formations, including those encompassing both areas below exposed earth and areas below earth covered by fresh water. The packing monitor and gravel pack system disclosed herein can also be used with cased wellbores in addition to open-hole wellbores.

FIG. 2 illustrates a diagram of an example of a gravel packing system 200 constructed according to the principles of the disclosure. The gravel packing system 200 is shown with respect to a portion of a wellbore 250 having casing 252 that has been perforated in a production zone 254. The gravel packing system 200 can also be used with an open-hole production zone, such as the first zone 124 or the second zone 128 of FIG. 1. The gravel packing system 200 includes a screen 210, packers 220, and a packing monitor 230. A completion assembly 240 is also illustrated in wellbore 250. The completion assembly 240 can be, for example, completion assembly 180 of FIG. 1. The screen 210 can be a part of the completion assembly 240.

The screen 210 holds particulates 260 in place during production within an annulus 270 created between the screen 210 and the casing 252. The packers 220 are positioned to contain the particulates in the annulus 270 within the production zone 254. Various positions along the length of the screen 210 are denoted by the numbers one to nine. The numbers can correspond to feet or another selected distance, such as meters. Connected to the screen 210 is the packing monitor 230. Various types of mechanical connections can be used to attach the packing monitor 230 to the screen 210.

The packing monitor 230 is configured to observe packing of the particulates 260 in real-time within the annulus 270 during a packing process. The packing monitor 230 includes a packing detector 232 and a packing controller 236. The packing detector 232 is configured to obtain stationary axial measurements indicating a presence of the particulates 260 within the annulus 270 at different positions along the length of the screen 210. The packing detector 232 includes a group of sensors 234, wherein each of the sensors 234 corresponds to a different position along the length of the screen 210. The sensors 234 can be radiation sensors that obtain radiation measurements from the particulates 260 in the annulus 270. One or more magnetic permeability sensors could also be used. The sensor corresponding to each position indicates the amount of particulate at that particular position of the screen 210 based on the radiation measurements. For example, numbers 1 to 9 are shown to indicate one foot to nine feet from the top to the bottom of screen 210. Each of the sensors 234 from two feet to nine feet would obtain measurements indicating the presence of particulate 260. The sensor 234 at the one foot position, wherein screen-out occurs, would not obtain radiation measurement from the particulate 260 in the illustrated example of FIG. 2.

The screen 210 and packing monitor 230 can be placed in the correct location within the production zone 254 by positioning one of the sensors 234 with respect to a radiation tag 256 located in the casing 250. The completion string 240 can be lowered into the wellbore 250 to align one of the sensors 234 with the radiation tag 256. The sensor 234 at the one foot position can be used for the alignment as shown in FIG. 2. The measurements obtained by the sensors 234 are sent to the packing controller 236 for analysis.

The packing controller 236 is configured to determine, based on the measurements, a status of the particulate 260 in the annulus 270 corresponding to the positions along the length of the screen 210. The packing controller 236 can include a processor having the logic to process the measurements and provide a status. The status can indicate a level of the particulate 260 within the annulus 270 per position of the screen 210. For example, the packing controller 236 can determine from the measurements that the particulate 260 is up to the two foot position of the screen 210. Based on the two foot position level, the packing controller 236 can indicate that screen-out is approaching and provide a screen-out warning. FIG. 4 illustrates an example of a plot representing the status of the particulate 260 in the annulus 270. The status determined by the packing controller 236 can be transmitted to the surface wherein an action can be initiated to modify the packing process, such as adjust particulate concentration, slurry flow rates, or treatment pressure. The status, and/or the measurements, can be sent to a computing device, such as with the control system 119 for presentation or additional processing. Presentation of the status can be visual, audible, or a combination of both.

Figure 9:
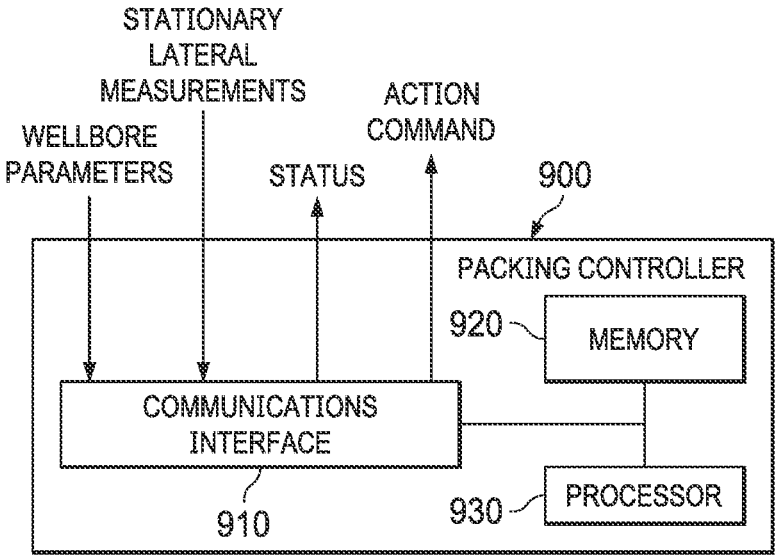
FIG. 9 illustrates a block diagram of an example of a packing controller constructed according to the principles of the disclosure.

The packing controller 236 can include a communications interface configured to transmit the status to the surface. The communications interface can also transmit the measurements to the surface for processing. A wireless acoustic system employing repeaters, for example, can be used for communicating within the wellbore 250. The communications interface can transmit one or more of the measurements or the status at different time intervals. The packing controller 236 can also include a memory configured to store the measurements, the status, or both at different time intervals. This stored data can transmitted up hole at a different time than when obtained or generated, i.e., not in real-time. In the example of FIG. 3 wherein the packing monitor is connected to an inner working tool string, the stored data can be downloaded when the packing monitor 230 is returned to the surface. The packing controller 900 of FIG. 9 provides an example of the configuration of the packing controller 236.

The packing monitor 230 can also include one or more wellbore parameter sensor 238 that determines wellbore parameters in the zone 254. The wellbore parameters, such as pressure and temperature, can be sent directly to the packing controller 236 and used as a secondary measurement(s) confirming when, for example, screen-out has occurred. The downhole measurements of the wellbore parameters can be beneficial for confirming a status downhole and automatically initiating a downhole action.

FIG. 3 illustrates a diagram of another example of a gravel packing system 300 constructed according to the principles of the disclosure. The gravel-packing system 300 includes screen 210, packers 220, packing monitor 230, and an inner working tool string 310. As with FIG. 2, the gravel packing system 300 is shown with respect to wellbore 250 having casing 252 that has been perforated in a production zone 254. In the example of FIG. 3, however, the packing monitor 230 is attached to inner working tool string 310 instead of screen 210. For the gravel packing system 300, the status and/or measurements can still be transmitted up hole. Additionally, the data stored on the packing monitor 230 can be obtained when the inner working tool string 310 is tripped to the surface. The packing monitor 230 can still provide a status, such as the plot of FIG. 4, in gravel packing system 300 as in gravel packing system 200.

Figure 5:
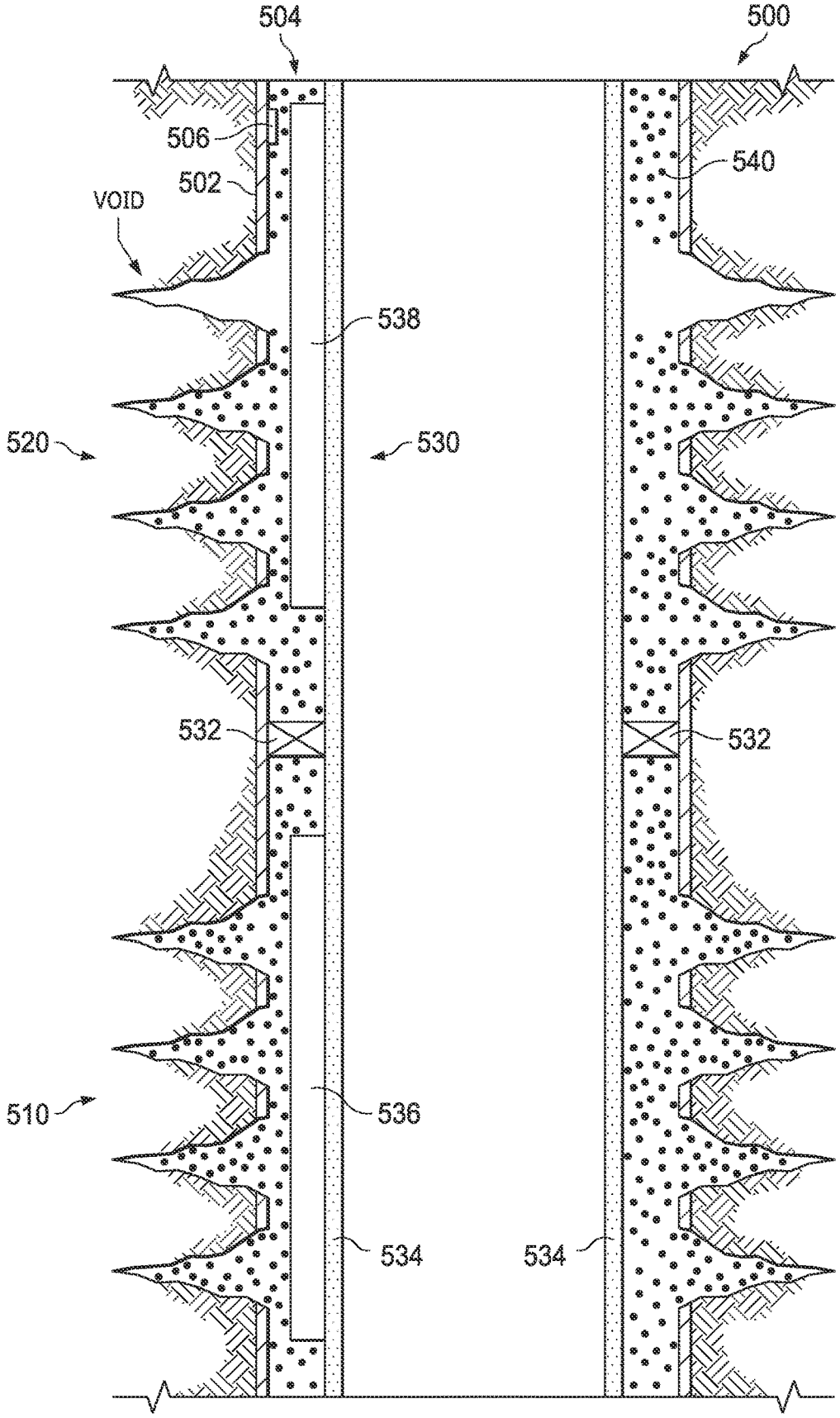
FIG. 5 illustrates a diagram of an example of a portion of a wellbore having two production zones that are gravel packed using a gravel packing system constructed according to the principles of the disclosure.

FIG. 4 illustrates a plot 400 that shows an example of a status that can be generated by a packing monitor, such as packing monitor 230 in FIGS. 2-3. The plot 400 represents a status based on radiation measurements obtained by a packing detector, such as packing detector 232. The status can be generated by a packing controller, such as packing controller 236. The plot 400 includes an x axis corresponding to positions along the length of a screen, such as screen 210, and a y axis indicating counts of radioactive measurements. The positions are in feet and correspond to the positions denoted on screen 210. The plot 400 provides a status of the packing process and indicates that screen-out is approaching. A status can also indicate the quality of a gravel pack, such as indicate the presence of voids. FIG. 5 illustrates an example of a void in a gravel pack. A particulate with different emission properties can be sequenced for different stages in the wellbore in order to provide a different measurement properties, such as radioactive or magnetic permeability properties, at different stages of the particulate placement.

FIG. 5 illustrates a diagram of an example of a portion of a wellbore 500 having two production zones 510, 520, that are gravel packed using a gravel packing system 530 constructed according to the principles of the disclosure. The wellbore 500 includes casing 502 that has been perforated. The gravel packing system 530 includes a packer 532 that separates zones 510, 520, a screen 534, and packing monitors 536, 538. The gravel packing system 530 can be part of a completion assembly. In this example, a single screen 534 is used for both production zones 510, 520. Instead of a single sleeve, each production zone can have their own screen. An annulus 504 is defined by the casing 502 and the screen 534. A radioactive tag 506 can be used to position the screen 534 is the proper position for production zones 510 and 520.

The packing monitors 536, 538, can be configured to operate as the packing monitor 230 of FIGS. 2 and 3. As such the packing monitors 536, 538, are configured to determine a status of a particulate 540 within the annulus 504 at different positions along a length of the screen 534 within each respective production zone 510, 520. The status is determined based on stationary axial measurements obtained during gravel packing of the productions zones 510, 520. In this example the measurements are radiation measurements. The status for both production zones 510, 520, can be sent up hole using, for example, wireless acoustics repeaters for at least a portion of the transmission.

FIGS. 6-7 illustrate examples of a status indicating the quality of gravel packing in the two different production zones 510, 520. FIGS. 6-7 illustrate plots having an x axis representing positions and y axis for radiation counts as in FIG. 4. The status for production zone 510 is represented by plot 600 of FIG. 6. Plot 600 indicates there are no voids in the annulus 504 in production zone 510. The status for production zone 520 is represented by plot 700 of FIG. 7. Plot 700 indicates there is a void between the two feet to five feet positions of screen 534 in the annulus 504 in production zone 520. The void is represented by the low amount of radiation counts detected between these positions. The counts measured in FIGS. 6-7, as with FIG. 4, can be, for example, alpha particles, beta particles, or gamma rays.

Figure 8:
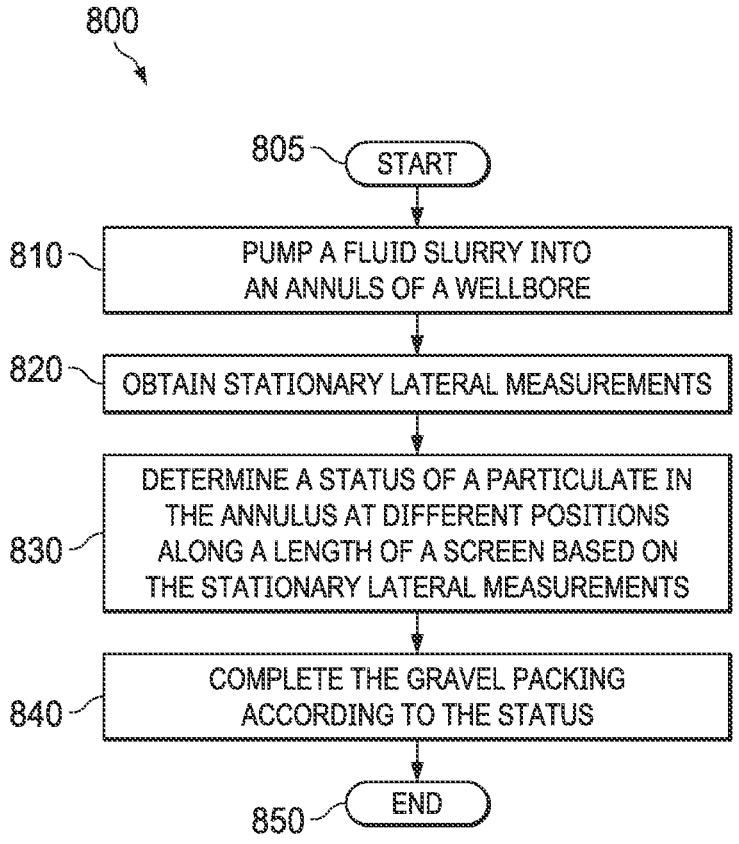
FIG. 8 illustrates a flow diagram of an example of a method of gravel packing a portion of a wellbore carried out according to the principles of the disclosure.

FIG. 8 illustrates a flow diagram of an example of a method 800 of gravel packing a portion of a wellbore carried out according to the principles of the disclosure. At least a portion of the method can be carried out by a packing monitor, such as packing monitor 230, as disclosed herein. The method begins in step 805.

In step 810, a fluid slurry is pumped into an annulus of the wellbore. The annulus is partially defined by a screen and corresponds to a production zone of the wellbore. The fluid slurry includes a particulate and can be pumped in a conventional way performed in the industry.

Stationary axial measurements are obtained in step 820. The stationary axial measurement indicate a presence of the particulate in the annulus at different positions along a length of the screen. The different positions can be evenly spaced apart at known distances. The positions can also be unevenly spaced apart. For example the positions on the lower part of screen can be separated by a distance of two feet and positions closer to the top of the screen can be separated by a distance of one foot. Accordingly, more measurements can be obtained closer to a position of screen-out to provide additional data for determining an action to take. The positions can be denoted by numbers, letters, or other known indicators that can be used to measure the depositing of a particulate along a screen during a gravel packing process. A packing detector such as disclosed herein can be used to obtain the stationary axial measurements. For example, an array of radiation sensors can be used to obtain the measurements.

In step 830, a status of the particulate in the annulus at the different positions is determined based on the stationary axial measurements. The status can be determined by a packing controller as disclosed herein. The packing controller can be integrated with the packing detector in a single device. A portion of the packing controller can be located distal from the packing detector. For example, a processor of the packing controller can be located at the surface or in another location within the wellbore. The status can be represented by plots corresponding to the positions. The status can also be statements, such as a screen-out warning. The status can be determined in real time during the gravel packing.

The gravel packing is completed in a step 840 according to the status. For example, the status can indicate a void and completing the gravel packing can include a top-off of the particulate in the annulus. Advantageously, the top-off can be performed without tripping out, for example, an inner working tool string used for the gravel packing.

In another example, the status can provide a screen-out warning, and completing the gravel packing can include reducing pumping of the fluid slurry. As such, the gravel packing process can be modified to prevent overshooting screen-out. The status can also indicate screen-out has occurred, wherein completing of the gravel packing includes stopping the pumping of the fluid slurry and reversing out of the wellbore excess of the particulate. Responding to the statuses can be automatic, manual, or a combination of both. Sleeves can be automatically operated downhole via the packing controller to complete the gravel packing process, can be operated via the surface, or via a combination. The method 800 ends in a step 850. The method 800 represents the gravel packing process for a single production zone. The method 800 can be repeated for another production zone in the wellbore or performed simultaneously in multiple production zones of the wellbore. For simultaneous operation, sleeves for each production zone can be independently operated based on a status for that production zone.

FIG. 9 illustrates a block diagram of an example of a packing controller 900 constructed according to the principles of the disclosure. The packing controller 900 or at least a portion thereof can be embodied as a series of operating instructions stored on a non-transitory computer-readable medium that direct the operation of a processor when initiated. At least a portion of the packing controller can be a computer program product that includes such operating instructions. The packing controller 900 provides an example of a packing controller that can be utilized with the packing monitors of FIGS. 1, 2, 3, and 5.

The packing controller 900 can be stored on a single computer or on multiple computers. The various components of the packing controller 900 can communicate via wireless or wired conventional connections. A portion of the packing controller 900 can be located downhole at one or more locations and other portions of the packing controller 900 can be located on a computing device or devices located at the surface. As described above, the packing controller 900 is part of a packing monitor and can be integrated in a single device with a packing detector.

The packing controller 900 can be configured to perform the various functions disclosed herein including receiving stationary axial measurements and based thereon determine a status of a particulate in an annulus of a wellbore at different positions along a length of a screen during a gravel packing process. The packing controller 900 includes a communications interface 910, a memory 920, and a processor 930.

The communications interface 910 is configured to transmit and receive data. For example, the communications interface 910 receives measurements from a packet detector and transmits status determined based on the measurements. The communications interface 910 can also transmit action commands that initiate downhole actions, such as operating sleeves to control or modify a gravel packing. The action commands can be automatically communicated based on a determined status. The action commands can be automatically communicated via various types of connections, such as a wireless or wired connection, to a downhole sleeve to operate the sleeve without receiving an operating command from the surface. A communication protocol determined by the sleeve can be used. The communications interface 910 can also transmit wellbore parameters, such as pressure and temperature up hole. The wellbore parameters can be determined from a packing monitor during gravel packing. The wellbore parameters can provide back-up confirmation for a status. The communications interface 910 can communicate via communication systems used in the industry for wellbore. For example, wireless acoustic communication systems can be used.

The memory 920 is configured to store a series of operating instructions that direct the operation of the processor 930 when initiated, including the code representing the algorithms for determining statuses based on stationary axial measurements. The memory 920 is a non-transitory computer readable medium. Multiple types of memory can be used for data storage and the memory 920 can be distributed.

The processor 930 is configured to determine a status or statuses based on the received stationary axial measurements. For example, the processor 930 can determine that screen-out is approaching and also determine that there is a void. The processor 930 can also be configured to direct the operation of the packing controller 900. As such, the processor 930 includes the necessary logic to communicate with the communications interface 910 and the memory 920 and perform the functions described herein to determine a status. Additionally the processor 930 can include the necessary logic to generate an action command to operate a downhole valve or sleeve. The action command can be communicated by the communications interface 910 using a required protocol.

A portion of the above-described apparatus, systems or methods may be embodied in or performed by various analog or digital data processors, wherein the processors are programmed or store executable programs of sequences of software instructions to perform one or more of the steps of the methods. A processor may be, for example, a programmable logic device such as a programmable array logic (PAL), a generic array logic (GAL), a field programmable gate arrays (FPGA), or another type of computer processing device (CPD). The software instructions of such programs may represent algorithms and be encoded in machine-executable form on non-transitory digital data storage media, e.g., magnetic or optical disks, random-access memory (RAM), magnetic hard disks, flash memories, and/or read-only memory (ROM), to enable various types of digital data processors or computers to perform one, multiple or all of the steps of one or more of the above-described methods, or functions, systems or apparatuses described herein.

Portions of disclosed examples or embodiments may relate to computer storage products with a non-transitory computer-readable medium that have program code thereon for performing various computer-implemented operations that embody a part of an apparatus, device or carry out the steps of a method set forth herein. Non-transitory used herein refers to all computer-readable media except for transitory, propagating signals. Examples of non-transitory computer-readable media include, but are not limited to: magnetic media such as hard disks, floppy disks, and magnetic tape; optical media such as CD-ROM disks; magneto-optical media such as floppy disks; and hardware devices that are specially configured to store and execute program code, such as ROM and RAM devices. Examples of program code include both machine code, such as produced by a compiler, and files containing higher level code that may be executed by the computer using an interpreter.

In interpreting the disclosure, all terms should be interpreted in the broadest possible manner consistent with the context. In particular, the terms "comprises" and "comprising" should be interpreted as referring to elements, components, or steps in a non-exclusive manner, indicating that the referenced elements, components, or steps may be present, or utilized, or combined with other elements, components, or steps that are not expressly referenced.

Those skilled in the art to which this application relates will appreciate that other and further additions, deletions, substitutions and modifications may be made to the described embodiments. It is also to be understood that the terminology used herein is for the purpose of describing particular embodiments only, and is not intended to be limiting, because the scope of the present disclosure will be limited only by the claims. Unless defined otherwise, all technical and scientific terms used herein have the same meaning as commonly understood by one of ordinary skill in the art to which this disclosure belongs. Although any methods and materials similar or equivalent to those described herein can also be used in the practice or testing of the present disclosure, a limited number of the exemplary methods and materials are described herein.

The summary section list various aspects that are disclosed herein. Each of these aspects can have one or more of the following additional elements in combination: Element 1: wherein the packing detector includes multiple radiation sensors, and each one of the multiple sensors corresponds to a different one of the positions along the length of the screen. Element 2: wherein the packing detector includes multiple magnetic permeability sensors, and each one of the multiple sensors corresponds to a different one of the positions along the length of the screen. Element 3: wherein the packing monitor further includes a wellbore parameter sensor configured to determine parameters of the wellbore proximate the annulus. Element 4: wherein the status indicates at least one of a void, a fill-level of the particulate, a screen-out warning, or screen-out. Element 5: wherein the packing controller is further configured to automatically initiate a downhole action during a packing process based on the status. Element 6: wherein the downhole action is operating a sleeve of a completion system in the wellbore. Element 7: wherein the packing controller includes a memory configured to store one or more of the measurements and the status at different time intervals. Element 8: wherein the packing controller further includes a communications interface configured to transmit the measurements, the status, or a combination thereof at different time intervals. Element 9: wherein the packing controller is configured to determine the status in real-time during a gravel packing process. Element 10: wherein the determining is performed in real time during the gravel packing. Element 11: further comprising completing the gravel packing according to the status. Element 12: wherein the status indicates a void and the completing includes a top-off of the particulate in the annulus. Element 13: wherein the status provides a screen-out warning, and the completing includes reducing pumping of the fluid slurry. Element 14: wherein the status indicates screen-out, and the completing includes stopping pumping of the fluid slurry and reversing out of the wellbore excess of the particulate. Element 15: wherein the packing monitor is attached to the screen. Element 16: wherein the packing monitor includes a packing detector having multiple radiation sensors configured to obtain the stationary axial measurements, and each one of the multiple sensors corresponds to one of the different positions. Element 17: further comprising a packing controller configured to determine the status and automatically initiate a downhole action to modify the gravel packing based on the status. Element 18: further comprising a packing controller configured to determine the status, wherein the packing controller includes a communications interface configured to transmit the status to the surface.

What is claimed is:

1. A packing monitor for use in a wellbore, comprising:

a packing detector including multiple sensors that each corresponds to different positions along a length of a screen and are each configured to, when stationary within the wellbore, obtain a measurement that individually indicates presence of a particulate in an annulus of the wellbore at each of the different positions along the length of the screen, wherein at least one of the different positions is used to indicate an approaching screen-out; and a packing controller configured to determine, based on the measurements, different statuses associated with the particulate in the annulus wherein the different statuses include a screen-out warning, generate a screen-out warning signal when a measurement from one of the multiple sensors located at the at least one of the different positions used to indicate an approaching screen-out indicates presence of the particulate, and automatically initiate at least one downhole action of operating a downhole valve or operating a sleeve in the wellbore during a packing process when the screen-out warning signal is generated.

2. The packing monitor as recited in claim 1, wherein the multiple sensors are multiple radiation sensors.

3. The packing monitor as recited in claim 1, wherein the multiple sensors are multiple magnetic permeability sensors.

4. The packing monitor as recited in claim 1, wherein the packing monitor further includes a wellbore parameter sensor configured to determine parameters of the wellbore proximate the annulus.

5. The packing monitor as recited in claim 1, wherein the different statuses further include a fill-level of the particulate, wherein the fill-level indicates a level of the particulate in the annulus relative to the different positions along the length of the screen.

6. The packing monitor as recited in claim 1, wherein the different statuses further include a screen-out.

7. The packing monitor as recited in claim 1, wherein the sleeve is a sleeve of a completion system in the wellbore.

8. The packing monitor as recited in claim 1, wherein the packing controller includes a memory configured to store one or more of the measurements and one or more of the different statuses at different time intervals, and further includes a communications interface configured to transmit the measurements, one or more of the different statuses, or a combination thereof at different time intervals.

9. The packing monitor as recited in claim 1, wherein the signals are audible signals.

10. The packing monitor as recited in claim 1, wherein the packing controller is configured to determine at least one of the different statuses in real-time during the packing process.

11. A method of gravel packing in a wellbore, comprising:

pumping a fluid slurry into an annulus of the wellbore, wherein the annulus is partially defined by a screen and the fluid slurry includes a particulate;

obtaining stationary measurements indicating presence of the particulate in the annulus at different positions along a length of the screen, wherein at least one of the different positions is used to indicate an approaching screen-out;

determining different statuses associated with the gravel packing based on the stationary measurements at the different positions, wherein the different statuses include a screen-out warning;

generating signals indicating the different statuses, wherein the signals include a screen-out warning signal when the measurements indicate presence of the particulate at the at least one of the different positions used to indicate an approaching screen-out; and automatically initiating at least one downhole action of operating a downhole valve or operating a sleeve in the wellbore during the gravel packing in response to the screen-out warning signal.

12. The method as recited in claim 11, wherein the determining is performed in real time during the gravel packing.

13. The method as recited in claim 11, further comprising completing the gravel packing according to the different statuses.

14. The method as recited in claim 13, wherein the different statuses further include a status that indicates a void and the completing includes a top-off of the particulate in the annulus.

15. The method as recited in claim 13, wherein the different statuses is the screen-out warning, and the completing includes preventing overshooting of screen-out by reducing pumping of the fluid slurry.

16. The method as recited in claim 13, wherein the different statuses further include a status that indicates screen-out, and the completing includes stopping pumping of the fluid slurry and reversing out of the wellbore excess of the particulate.

17. A gravel packing system for a wellbore, comprising:

a screen; and a packing monitor configured to determine, based on stationary axial measurements obtained during gravel packing, different statuses of the gravel packing corresponding to a particulate at different positions along a length of the screen, wherein at least one of the different positions is used to indicate an approaching screen-out, generate signals indicating the different statuses, wherein the different statuses include a screen-out warning, and the signals include a screen-out warning signal when the measurements indicate presence of the particulate at the at least one of the different positions used to indicate an approaching screen-out, and automatically initiate at least one downhole action of operating a downhole valve or operating a sleeve in the wellbore during the gravel packing based on the screen-out warning signal.

18. The gravel packing system as recited in claim 17, wherein the packing monitor is attached to the screen.

19. The gravel packing system as recited in claim 17, wherein the packing monitor includes a packing detector having multiple radiation sensors configured to obtain the stationary axial measurements, and each one of the multiple sensors corresponds to one of the different positions.

20. The gravel packing system as recited in claim 17, wherein the packing monitor is further configured to transmit the different statuses to the surface.

21. The gravel packing system as recited in claim 20, further comprising a computing device at the surface and configured to initiate at least one surface action during the packing process based on the different statuses, wherein the at least one surface action includes at least one of adjusting a particulate concentration, adjusting a slurry rate, or adjusting a treatment pressure.

* * * * *